United States Patent [19]

Dobler

[11] 4,356,979

[45] Nov. 2, 1982

[54] FUEL INJECTION NOZZLE

[75] Inventor: Klaus Dobler, Gerlingen, Fed. Rep. of Germany

[73] Assignee: Robert Bosch GmbH, Stuttgart, Fed. Rep. of Germany

[21] Appl. No.: 146,866

[22] Filed: May 5, 1980

[30] Foreign Application Priority Data

May 22, 1979 [DE] Fed. Rep. of Germany ..... 2920669

[51] Int. Cl.[3] ..... B05B 1/30

[52] U.S. Cl. ..... 239/585; 73/119 A

[58] Field of Search ..... 239/585, 533.2–533.12; 73/119 A, 119 R

[56] References Cited

U.S. PATENT DOCUMENTS 3,412,602 11/1968 Rush et al. ..... 73/119 A 4,227,402 10/1980 Dooley et al. ..... 73/119 A X

*Primary Examiner*—Robert B. Reeves

*Assistant Examiner*—Gene A. Church

*Attorney, Agent, or Firm*—Edwin E. Greigg

[57] ABSTRACT

A fuel injection nozzle having a built-in transducer for detecting the onset of injection or the duration of injection by means of a signal. The transducer is dimensioned so as to be housed in the nozzle holder without altering the external shape of the injection nozzle. The transducer may be a Hall transducer or a field-dependent resistor probe.

11 Claims, 5 Drawing Figures

FUEL INJECTION NOZZLE

BACKGROUND OF THE INVENTION

The invention relates to a fuel injection nozzle of the general type described. Particularly suitable for effective electronic Diesel injection regulation is the provision of a transducer in the injection nozzle to detect injection tuning, either the onset of injection, (that is, the opening of the nozzle) or to detect the injection needle stroke duration, (that is, the travel of the nozzle needle over time) and to generate a signal therefrom.

A contact-free distance measurement with an inductive receiver is already known, which criterion can be used for measuring the needle stroke. The significant expense of a carrier frequency amplifier and the highly distance-dependent sensitivity of the measurement signal very probably militate against a commercially-oriented application thereof.

Studies have shown that a transducer which functions on the opto-electronic principle is not commercially practicable because initially single oil drops and later air bubbles or foaming of the oil can cause problems.

A transducer functioning by the electrostatic principle has been studied; such transducer comprises a metallic inner electrode, a cylindrical dielectric and the compression spring of the nozzle holder as a second electrode. As a result of the spring movement upon injection, a voltage appears at the transducer which, however, only becomes usable as a signal for the onset of injection after appropriate further processing thereof has been performed.

OBJECT AND SUMMARY OF THE INVENTION

It is a principal object of the present invention to provide a fuel injection nozzle which has the advantage over the known prior art of supplying a Hall transducer via series resistors directly from the direct current voltage of a 12-volt battery.

It is another object of the invention that the Hall voltage produced can be further directly processed electronically without subsequent amplification. With a full stroke of the nozzle needle, the Hall voltage here amounts to approximately 100 mV, and it has excellent linearity.

It is a further object of the invention to provide an injection valve needle movement measurement sensor which can be housed inexpensively in the injection nozzle without altering its external form.

It is a still further object of the invention to provide a sensor whose use on a mass basis for fuel injection nozzles in electronic Diesel injection regulation is indicated both as technically feasible as commercially economic.

As a result of the characteristics disclosed herein, advantageous further embodiments of and improvements to the fuel injection nozzle disclosed in the independent claims are possible.

The invention will be better understood, and further objects and advantages thereof will become more apparent from the ensuing detailed description of the preferred embodiments taken in conjunction with the drawings.

DESCRIPTION OF THE PREFERRED EMBODIMENTS

Figure 1:
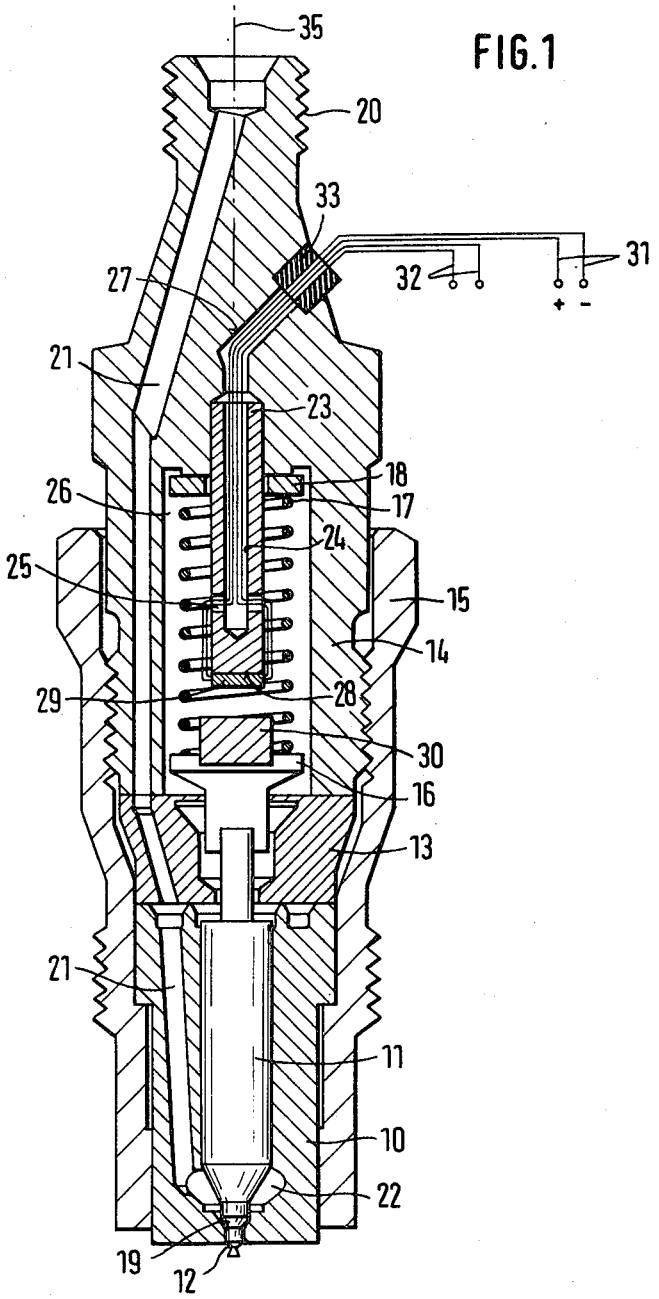
FIG. 1 is a cross-sectional view of a fuel injection nozzle having a Hall transducer.

The fuel injection nozzle for internal combustion engines in FIG. 1 substantially comprises a nozzle body 10, a valve needle 11 displaceable axially therein and arranged to control an injection opening 12, an intermediate plate 13 and a nozzle holder 14, which is connected to the nozzle body 10 by means of a box nut 15. A closing spring 17, which is supported on the nozzle holder 14 via a shim plate 18, presses a compression element 16 against the valve needle 11, which meanwhile, at rest against the valve seat 19, assumes a closed position. A channel 21 for the fuel delivery, which begins at the connection piece 20 of the nozzle holder 14, discharges into a pressure chamber 22. The upper end of the valve needle is provided with a small diameter extension upon which the compression element 16 is secured. The upper end of the larger diameter portion functions as a stop which limits the axial movement or stroke of the valve needle.

A spring retainer 23 is disposed with one extremity extending into the nozzle holder 14, and the other extremity protruding into a spring chamber 26, which chamber has a connection channel 27 directed substantially opposite from the needle valve 11. The spring retainer 23 is provided with a partially-extending axial bore 24 in alignment with the connection channel 27 and communicating with a lateral jacket bore 25.

A Hall transducer comprises a Hall chip 29, which is secured laterally to the end face 28 of the spring retainer 23 and a permanent magnet 30 secured on the compression element 16. The distance provided between the Hall chip 29 and the permanent magnet 30 defines the duration of the stroke of the valve needle 11. Two control lines 31 connect the Hall chip 29 to the vehicle electrical system, and two Hall lines 32 lead from the Hall chip 29 to the outside. A sealing plug 33 seals the lines 31 and 32 from the nozzle holder 14.

When the valve needle 11 opens, the compression bolt 16 with the permanent magnet 30 secured therein is moved toward the Hall chip 29. As a result, the magnetic field which passes transversely through the Hall chip 29 is altered, which causes an alteration of the Hall voltages which are to be measured at the Hall lines 32. This Hall voltage, in the selected disposition, is virtually linear to the distance between the permanent magnet 30 and the Hall chip 29, so that the injection timing, that is the onset of injection and the needle stroke duration, can be detected.

Figure 2:
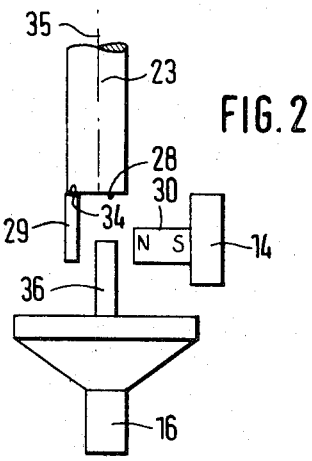
FIG. 2 is a schematic view of a first variant of the embodiment of FIG. 1.

In the first variant of the Hall transducer shown in FIG. 2, the chip 29 is secured with its narrow edge 34 on the end face 28 of the stop 23 and parallel to the axis 35 thereof. A magnetic field interrupter 36 made of easily magnetizable material is secured on the compression bolt 16 in alignment with the axis 35, and the permanent magnet 30 is fixed in a stationary mounting on the nozzle holder 14, indicated sectionally.

Figure 3:
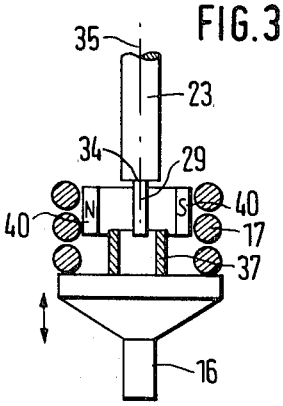
FIG. 3 is a schematic view of a second variant of the embodiment of FIG. 1.

In the second variant of FIG. 3, the Hall chip 29 is secured on the spring retainer 23 with the edge 34 in alignment with the axis 35. The permanent magnet 40 takes the form of a C-shaped element disposed coaxially with the axis 35 between the spring retainer 23 and a magnetic field interrupter 37 of easily magnetizable material. The interrupter 37 is provided in an annular form and is secured to the compression element 16 coaxially with the axis 35.

Figure 4:
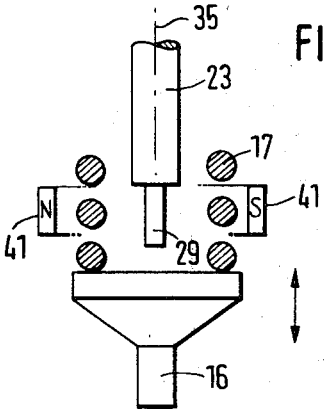
FIG. 4 is a schematic view of a third variant of the embodiment of FIG. 1.

In the third variant shown in FIG. 4, the compression spring 17 is disposed inside the permanent magnet 41 and functions as the magnetic field interrupter.

Figure 5:
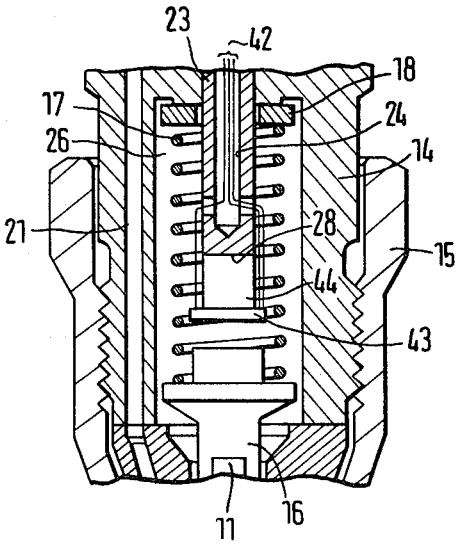
FIG. 5 is a sectional view of a critical area of a second embodiment of a fuel injection nozzle having a field-dependent resistor transducer.

In FIG. 5, the elements identical to those of FIG. 1 are given identical reference numerals. A differential field-dependent resistor probe is secured to the end face 28 of the spring retainer 23 and is provided with a permanent magnet 44 and a field-dependent resistor 43. Three signal lines 42 lead to the outside. Here, as well, the distance from the field-dependent resistor 43 to the compression element 16 defines the duration of the stroke of the valve needle 11.

When the valve needle 11 is opened, the compression element 16 is moved toward the field-dependent resistor probe. The magnetic field which passes through the field-dependent resistor 43 is altered by the approach of the compression bolt, which causes an alteration in the resistance of the field-dependent resistor. This alteration in resistance is efficiently detected as an alteration in voltage via a bridge circuit.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines comprising a spring-loaded valve needle for regulating the onset of fuel injection, a spring retainer means, a Hall transducer for indicating the onset of the fuel injection and/or the length of the fuel injection, said Hall transducer including a stationary Hall chip secured within and surrounded by said spring retainer means, and a permanent magnet, the magnetic influence on the Hall chip of said permanent magnet changing with the stroke of the valve needle, characterized in that said permanent magnet is disposed in a position not hindering the stroke of the valve needle.

2. A fuel injection nozzle as defined by claim 1, wherein the nozzle includes at least one compression element and a valve needle stroke limiting stop, wherein said permanent magnet is secured on the compression element and wherein said Hall chip is secured laterally on the end face of said spring retainer means, whereby the injection timing controls said needle valve.

3. A fuel injection nozzle as defined by claim 1, wherein the nozzle includes at least one compression element and a valve needle stroke limiting stop, wherein said permanent magent of the Hall transducer is stationary and has a magnetic field extending to said chip, said Hall chip is secured on an edge thereof to an end face of said spring retainer means, and wherein a magnetizable field interrupter is disposed so as to extend at least partially into the magnetic field of said permanent magnet, whereby the injection timing controls said needle valve.

4. A fuel injection nozzle as defined by claim 3, wherein said Hall chip is disposed parallel to the axis of said spring retainer means, and wherein the magnetic field interrupter is disposed in axial alignment with the compression element.

5. A fuel injection nozzle as defined by claim 3, wherein the permanent magnet is substantially C-shaped and is disposed to surround said Hall chip, wherein said field interrupter is an annular field interrupter secured to said compression element.

6. A fuel injection nozzle as defined by claim 3, further including a closing spring arranged to act upon said compression element wherein said closing spring serves as the field interrupter.

7. A fuel injection nozzle for internal combustion engines comprising a spring-loaded valve needle for regulating the onset of fuel injection, a Hall transducer for indicating the onset of the fuel injection and/or the length of the fuel injection, said Hall transducer including a stationary Hall chip and a permanent magnet, the magnetic influence on the Hall chip of said permanent magnet changing with the stroke of the valve needle, characterized in that said permanent magnet is stationarily disposed in a position not hindering the stroke of the valve needle, and a magnetizable magnetic field interrupter made of a magnetizable material coupled with said valve needle, said interrupter covering variable sized areas of said Hall chip in the end positions of said valve needle in relationship with the permanent magnet.

8. A fuel injection nozzle according to claim 7, characterized in that said permanent magnet is in the form of a half ring, disposed with equal radial distance from a closing spring, and that the Hall chip is disposed on the inside of the closing spring.

9. A fuel injection nozzle according to claim 8, the closing spring of which rests on the valve needle by means of a compression element, characterized in that the interrupter is fastened to the compression element and has an annular shape.

10. A fuel injection nozzle according to claim 8, characterized in that the permanent magnet (41) is disposed outside of the closing spring (17) and that the closing spring (17) itself acts as said interrupter.

11. A fuel injection nozzle according to claim 7 which includes a spring retainer means, and said Hall chip is secured on one end of said spring retainer means.

* * * * *